US006077122A

United States Patent [19]

Elkhatib et al.

[11] Patent Number: 6,077,122

[45] Date of Patent: Jun. 20, 2000

[54] ELECTRICAL CONNECTOR HAVING AN IMPROVED CONNECTOR SHIELD AND A MULTI-PURPOSE STRAIN RELIEF

[75] Inventors: Hecham K. Elkhatib, Memphis, Tenn.; Laura A. Gruno, Olive Branch, Miss.; Bernard H. Hammond, Cordova, Tenn.; Mark Bieberich, Edina, Minn.

[73] Assignee: Thomas & Bett International, Inc., Sparks, Nev.

[21] Appl. No.: 09/183,017

[22] Filed: Oct. 30, 1998

Related U.S. Application Data

[60] Provisional application No. 60/064,356, Oct. 30, 1997, provisional application No. 60/064,370, Oct. 30, 1997, and provisional application No. 60/074,102, Feb. 9, 1998.

[51] Int. Cl.[7] ..... H01R 13/648

[52] U.S. Cl. ..... 439/608; 439/417; 439/469

[58] Field of Search ..... 439/608, 607, 439/610, 404, 417, 98, 460, 469, 472

[56] References Cited

U.S. PATENT DOCUMENTS

| | | | |
|---|---|---|---|
| 4,744,369 | 5/1988 | Kroll . | |
| 5,445,538 | 8/1995 | Rodrigues et al. . | |
| 5,518,421 | 5/1996 | Davis | 439/607 |
| 5,538,440 | 7/1996 | Rodrigues et al. . | |
| 5,564,940 | 10/1996 | Rodrigues et al. . | |
| 5,593,311 | 1/1997 | Lybrand | 439/295 |
| 5,611,711 | 3/1997 | Okada | 439/608 |
| 5,681,180 | 10/1997 | Rodrigues | 439/404 |
| 5,766,033 | 6/1998 | Davis | 439/405 |
| 5,895,292 | 4/1999 | Affeltranger . | |

FOREIGN PATENT DOCUMENTS

| | | |
|---|---|---|
| 0 587 303 A2 | 3/1994 | European Pat. Off. . |
| 0 634 816 A1 | 1/1995 | European Pat. Off. . |
| 0 653 811 A1 | 5/1995 | European Pat. Off. . |

OTHER PUBLICATIONS

Thomas & Betts Catalog for ALL–LAN Interconnection System, pp. 1–12 (1995 in U.S.A.). No month Specified.

Thomas & Betts Installation Instructions for ALL–LAN Interconnection System—Shielded Plug (Published at least as early as 1997 in U.S.A.). No month Specified.

Thomas & Betts Installation Instructions for ALL–LAN Interconnection System—Shielded Field Installation Jack (Published at least as early as 1997 in U.S.A.).

*Primary Examiner*—Lincoln Donovan
*Assistant Examiner*—Javaid Nasri
*Attorney, Agent, or Firm*—Hoffmann & Baron, LLP

[57] ABSTRACT

An electrical connector having an improved connector shield and a multi-purpose strain relief includes an electrically insulative contact support member having a rearward cable termination end and a plurality of electrical contacts positioned on the support member forward of the termination end. An electrically conductive contact shield housing having an outer and inner walls surrounds the contact support member and extends rearward beyond the electrical contacts to shield both the contacts and the discrete conductors of a multi-conductor cable. The connector includes an electrically conductive strain relief device comprised of mirrored strain relief members which are in electrical communication with the shield housing and the cable ground thereby providing a ground path between the cable ground and the contact shield housing.

28 Claims, 9 Drawing Sheets

ELECTRICAL CONNECTOR HAVING AN IMPROVED CONNECTOR SHIELD AND A MULTI-PURPOSE STRAIN RELIEF

CROSS-REFERENCE TO RELATED APPLICATIONS

This application claims priority to U.S. provisional applications, Ser. Nos. 60/064,356 and 60/064,370, both filed on Oct. 30, 1997, and Ser. No. 60/074,102, filed on Feb. 9, 1998.

FIELD OF THE INVENTION

The present invention relates generally to improvements in electrical data connectors. More particularly, the present invention relates to a compact data connector with an improved connector ground shield and a multi-purpose strain relief.

BACKGROUND OF THE INVENTION

In the field of data/communications technology, information in the form of electrical signals is being transmitted at ever increasing speeds. Along with the desire to transmit information at faster data rates, the industry has also seen the need to reduce the size of hardware employed so as to increase portability and ease of use. In order to keep pace with these improvements, the interconnection technology, which includes electrical cables and electrical connectors designed to connect such hardware, has also undergone significant changes. Electrical connectors and cables are now available with are much smaller in size and capable of transmitting data at higher rates.

Continued improvement in connection technology is not without problems. When decreasing the size of electrical connectors while requiring the connectors to transmit data at higher rates, cross-talk between adjacent conductive components of the connector becomes a factor which must be addressed. Additionally, as these components are normally used in close proximity to other electronic components, the individual connector components must be shielded from electromagnetic interferences and radio-frequency interferences. These interferences can adversely affect the performance levels of the connectors especially at higher data rates.

Commonly owned U.S. Pat. Nos. 5,538,440 and 5,564,940 to Rodrigues, et al, the disclosures of which are incorporated herein by reference, disclose compact electrical connectors which provide for the termination of discrete insulated conductors of a multi-conductor cable. The connectors include an insulative connector housing supporting a plurality of electrical contacts having insulation displacing contact portions. The connector also features an internal contact shield to shield individual contact pairs from adjacent contact pairs. The shield is a die cast metallic member having horizontal and vertical walls which intersect perpendicularly in "cross" configurations to provide horizontal and vertical shielding of the contacts. The contact shield disclosed in these patents also includes an extended ground element for electrical engagement with the multi-conductor cable to maintain electrical ground continuity between the cable and the contact shield. The cable receiving end of the connector also includes a two component strain relief device which helps secure the cable in the connector. The strain relief device engages the folded back portion of the cable braid to frictionally hold the cable to the connector. A separate metallic ground clip is positioned between the strain relief device and the cable ground braid which electrically engages the extended ground element of the contact shield to establish electrical continuity between the cable braid and the contact shield.

One of the disadvantages of the above-disclosed connector is that the vertical and horizontal walls of the connector shield extend only as far as the insulation displacing contact portions of the electrical contacts. Thus, a portion of the individual conductors of the multi-conductor cable between the end of the cable braid and the insulation displacing contacts is left unshielded. Furthermore, strain relief devices of conventional connectors typically only provide the function of securing the cable to the connector. Grounding of the cable is normally accomplished by the use of one or more separate components, such as a separate ground clip as an interface between the cable ground braid and the contact shield. This adds to the complexity and cost of the connector.

Therefore, it would be desirable to provide an electrical connector which provides overall and individual shielding of the electrical contacts as well as the termination ends of the conductors engaging therewith. It would also be desirable to eliminate the requirement for separate components within the connector to ensure electrical continuity between the cable ground braid and the connector contact shield.

SUMMARY OF THE INVENTION

It is an object of the present invention to provide an electrical connector for terminating discrete conductors of a multi-conductor cable.

It is a further object of the present invention to provide an electrical connector having a contact shield for shielding the electrical contacts of the connector as well as the discrete conductors of the multi-conductor cable engaging therewith.

It is still a further object of the present invention to provide a strain relief device for an electrical connector which in addition to securing the multi-conductor cable to the connector also provides for electrical grounding of the cable to the connector thereby eliminating the need for separate components.

In accordance with one form of the present invention, the improved electrical connector generally includes an electrically insulative contact support member having a rearward cable termination end, a plurality of electrical contacts supported thereon and an electrically conductive contact shield housing substantially surrounding the support member. Preferably, the connector also includes an electrically insulative housing which may be in the form of two halves which snap-fit together to substantially enclose the contacts and the shield. The contacts include conventional conductor termination end portions which are electrically connected to individual conductors of the multi-conductor cable. Dressing blocks may also be provided which snap-fit to the contact support member over the contact end portions to secure the conductors in place. The contacts are positioned upon the contact support member so that the termination end portions are spaced forward of the termination end of the support member to allow for a length of the separated individual conductors of the multi-conductor cable to be supported on a conductor support portion of the contact support member. The contact shield housing includes an outer wall which substantially surrounds the contacts and one or more inner walls are positioned so as to form an inner contiguous cross member to physically separate one or more contacts from the others. The contact support member includes one or more longitudinal slots between the contacts for receiving the one or more inner walls forming the cross member of the contact shield housing. Unlike prior art connectors, the outer and inner walls of the contact shield housing extend rearward beyond the contact conductor termination end portions and terminate adjacent the termination end of the contact support member. Thus, the extended contact shield not only electrically isolates the contacts but also shields a length of individual conductors supported on the conductor support portion of the contact support member positioned within the shield housing. The result is a dramatic improvement in "cross-talk" performance of the connector.

The present invention also includes a novel strain relief device positioned adjacent the termination end of the shield housing for securing the multi-conductor cable to the connector. The strain relief device is made from an electrically conductive material, preferably formed from a metallic material. The strain relief device is comprised of mirrored strain relief members which, when engaged, define a substantially circular bounded opening adjacent the termination end of the housing. The circular bounded opening is reduced in size as the strain relief members are moved toward each other to frictionally secure and electrically engage a ground braid of the multi-conductor cable. The strain relief members are preferably received in opposing slots which extend through an outer wall of the contact shield housing adjacent the termination end thereof and are in electrical communication with the shield housing. The strain relief members may also include one or more raised protrusions to enhance electrical contact between the strain relief member and the shield housing. Thus, unlike prior art strain relief devices, the electrically conductive strain relief members of the present invention provide ground continuity between the cable ground braid and the connector shield housing. The strength of the metallic members also allows for the use of a thinner strain relief device thereby reducing the overall size of the connector.

A preferred embodiment of an electrical data connector with an improved connector shield and a multi-purpose strain relief, as well as other objects, features and advantages of this invention, will be apparent from the following detailed description which is to be read in conjunction with the accompanying drawings.

DETAILED DESCRIPTION OF THE PREFERRED EMBODIMENT

Figure 1:
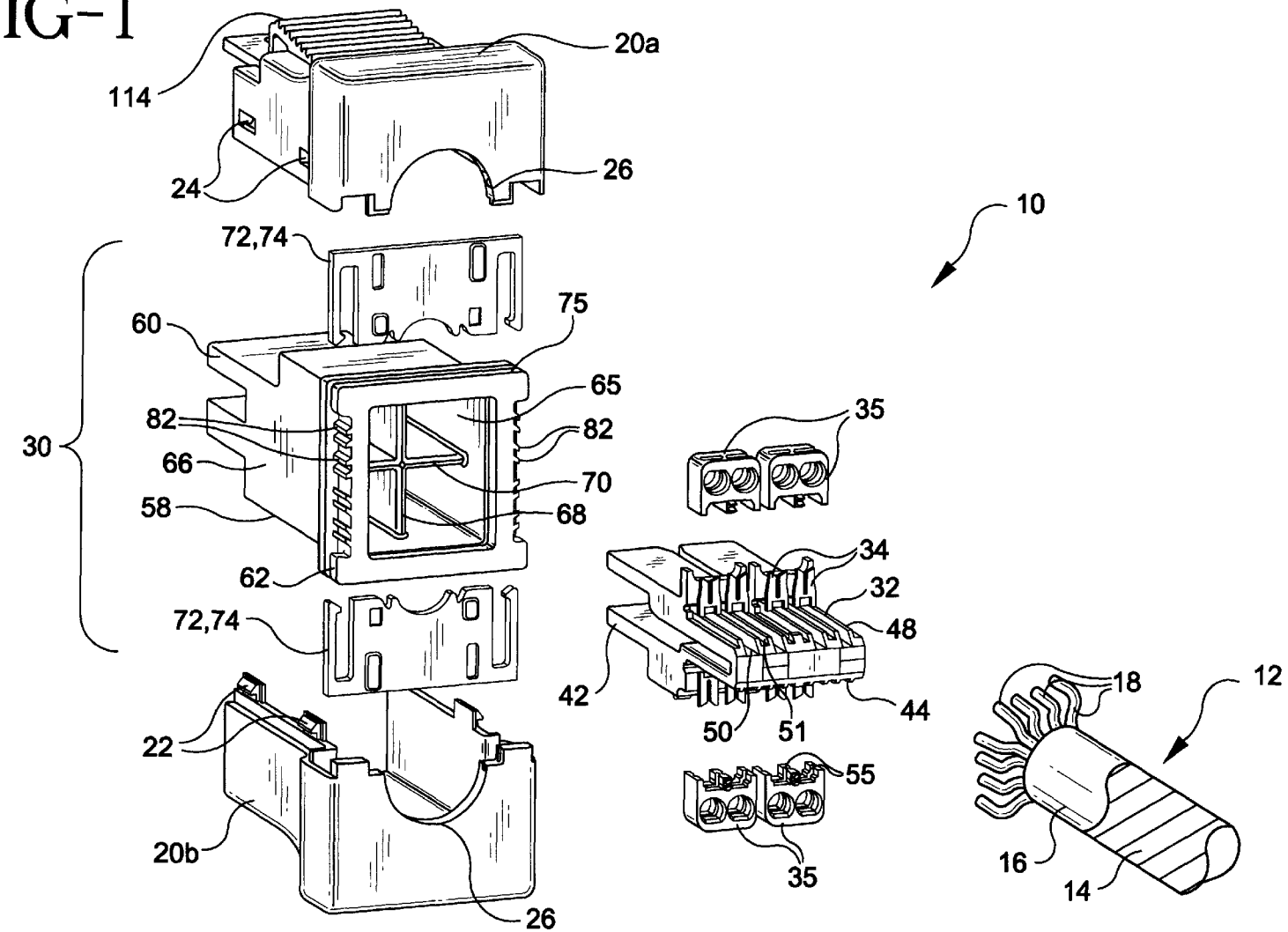
FIG. 1 is an exploded rear perspective view of the electrical connector formed in accordance with the present invention.
Figure 2:
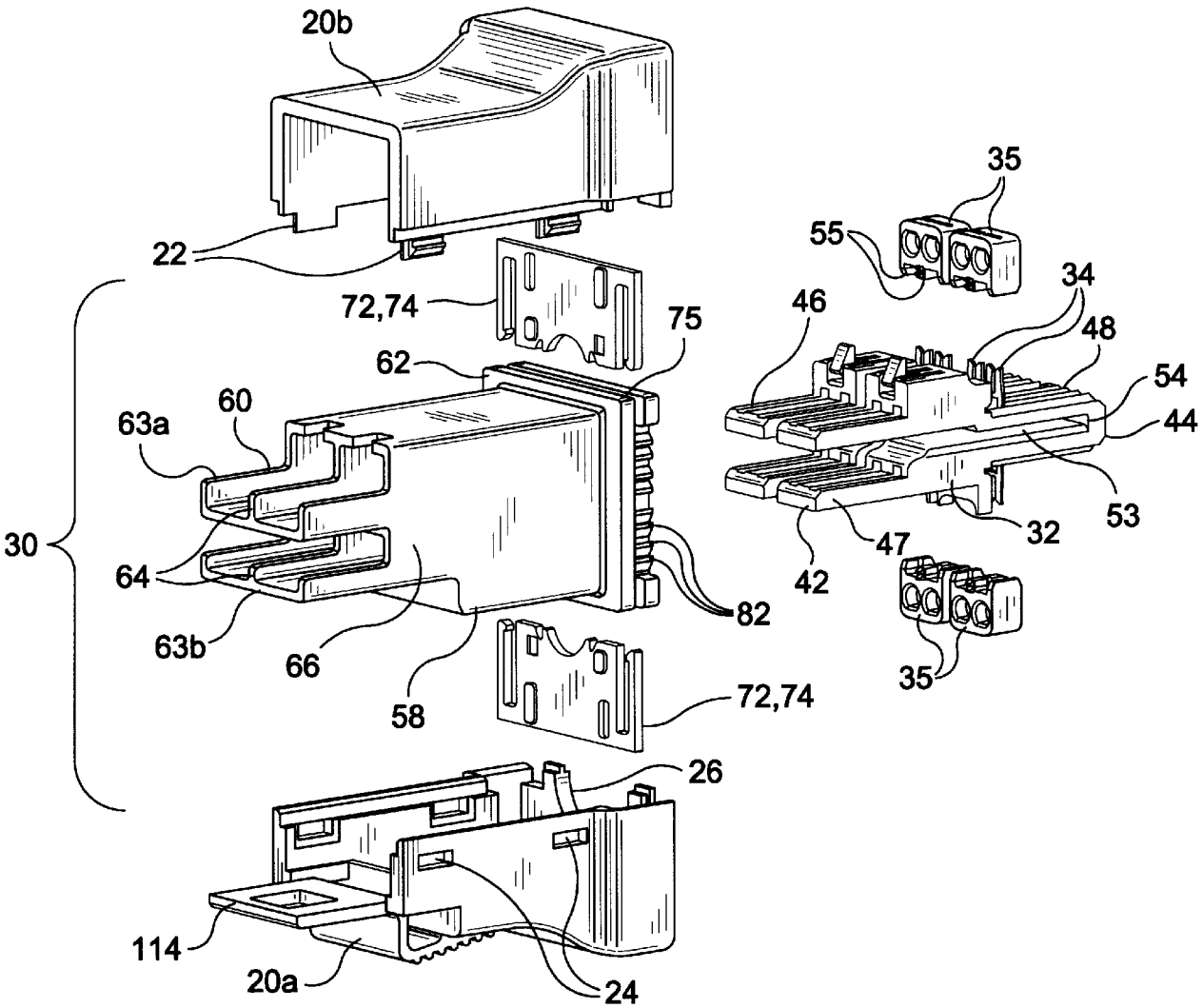
FIG. 2 is an exploded front perspective view of the electrical connector of FIG. 1.
Figure 3:
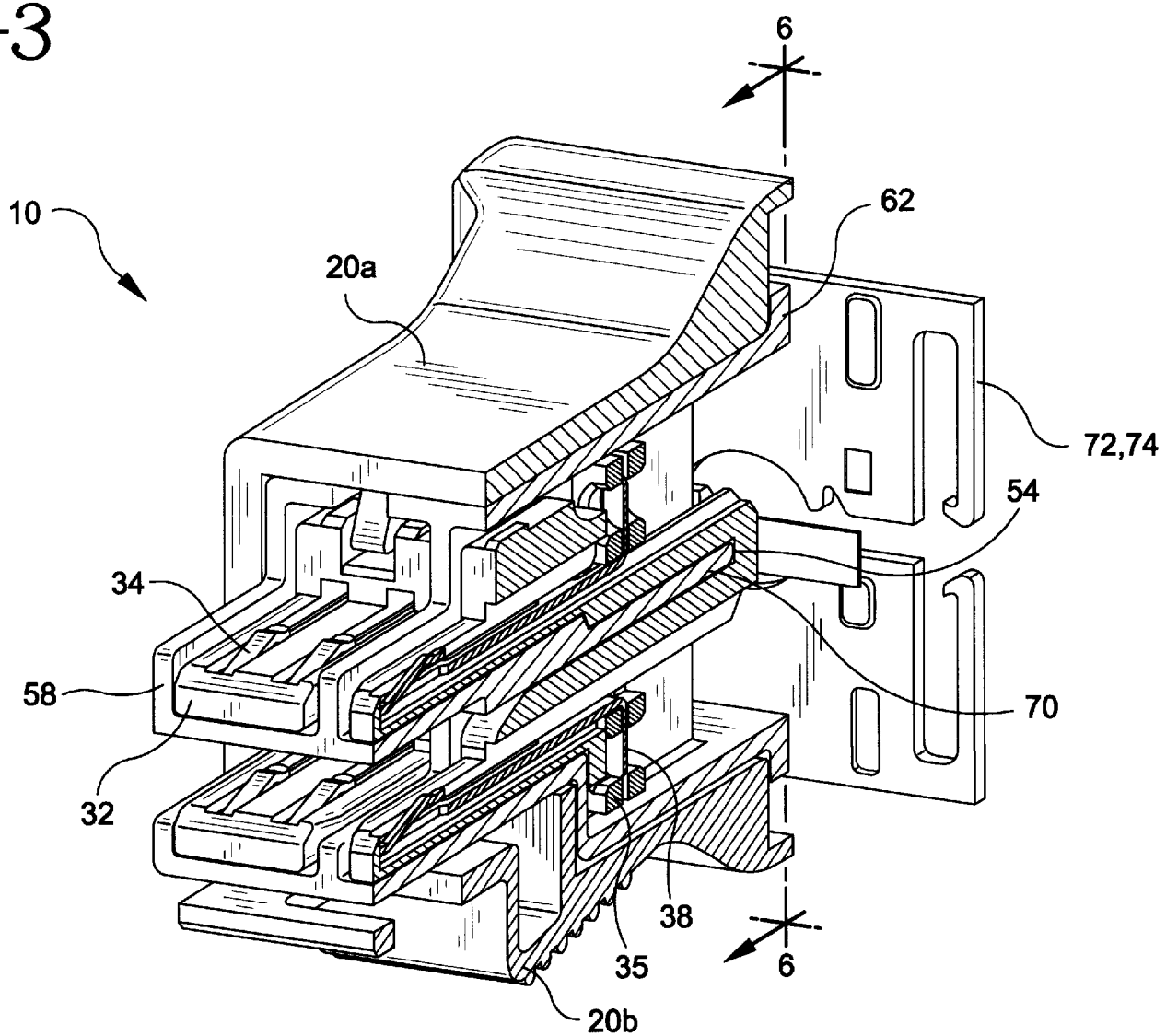
FIG. 3 is a perspective view of a cross-section of the electrical connector of FIGS. 1 and 2 as assembled.

Referring to FIGS. 1–3, a shielded electrical data connector 10 is shown in an exploded view. Connector 10 may be employed to terminate electrical cable 12 having an insulative outer jacket 14, an inner ground conductor or cable braid 16 and a plurality of individually insulated electrical conductors 18 extending therethrough. In order to prepare cable 12 for termination in connector 10, jacket 14 is cut-away exposing a portion of cable braid 16 and a length of conductors 18 suitable for termination. While it may be appreciated that the invention may be employed with cables having any number of conductors, in the present illustrated embodiment, cable 12 is an eight conductor cable comprising four pairs of individual conductors.

Connector 10 includes outer connector housing halves 20*a* and 20*b* which when assembled may take the form of a plug as shown in FIGS. 1–3 or a jack (not shown). The assembled housing for the jack is designed to receive and to connect with the housing of the plug. Connector housing halves 20*a* and 20*b* include a plurality of locking arms 22 which cooperatively engage recesses 24 to provide for a snap-fit engagement of the halves. Housing halves 20*a* and 20*b* may be formed of any suitably electrically insulative plastic material such as polyester. Connector housing halves 20*a* and 20*b* each have a cable termination end 26 which when assembled define a rearwardly opening circular passage which permits entry of cable 12 into connector 10.

Connector housing halves 20*a* and 20*b* support therein a termination subassembly 30 which is identical for both the jack and the plug configurations of the connector. Termination subassembly 30 includes a contact support member 32, a plurality of electrical contacts 34, a plurality of dressing blocks 35, a contact shield 58 and a strain relief device 72.

Figure 4:
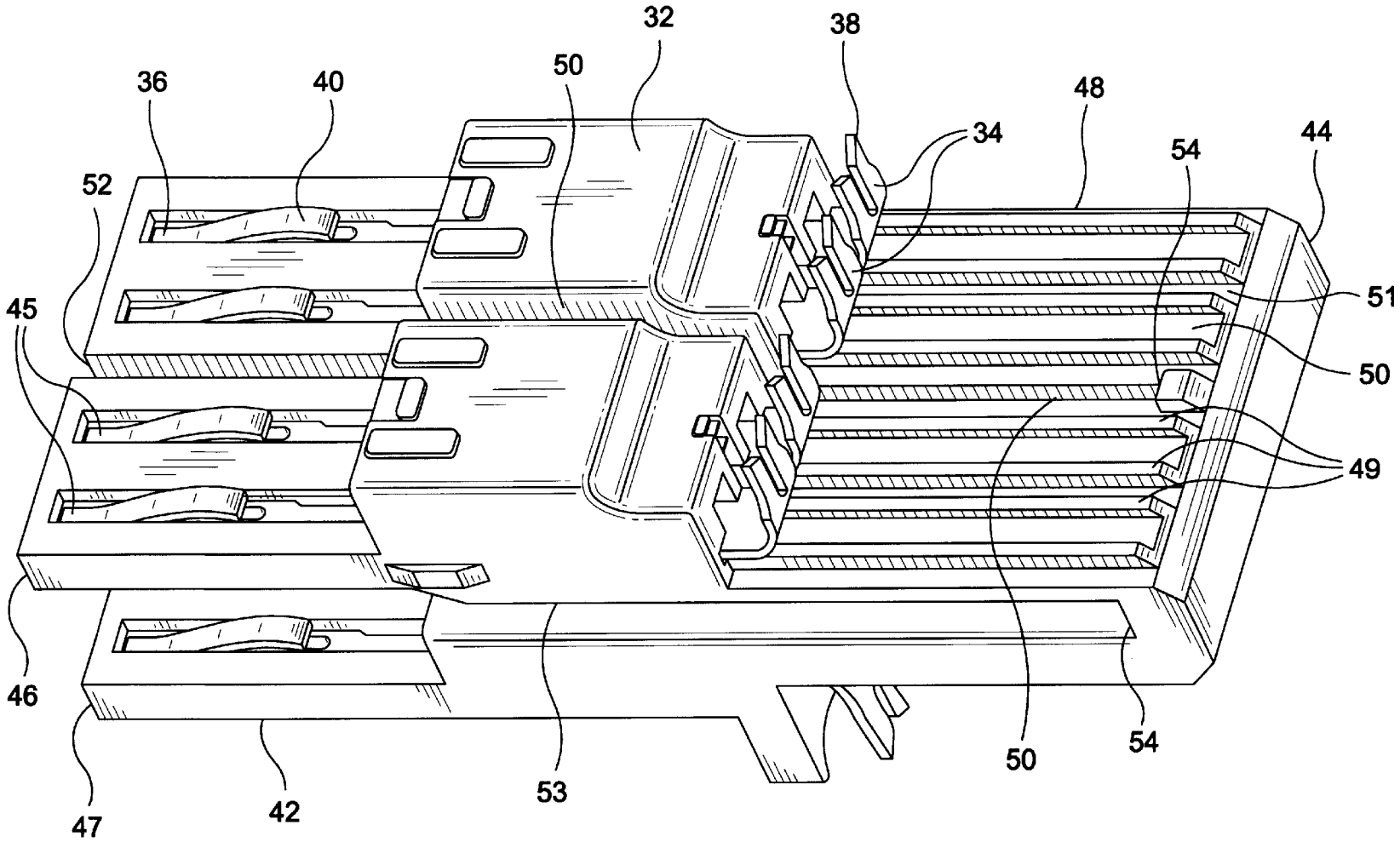
FIG. 4 is a perspective view of the contact support member with contacts.
Figure 5:
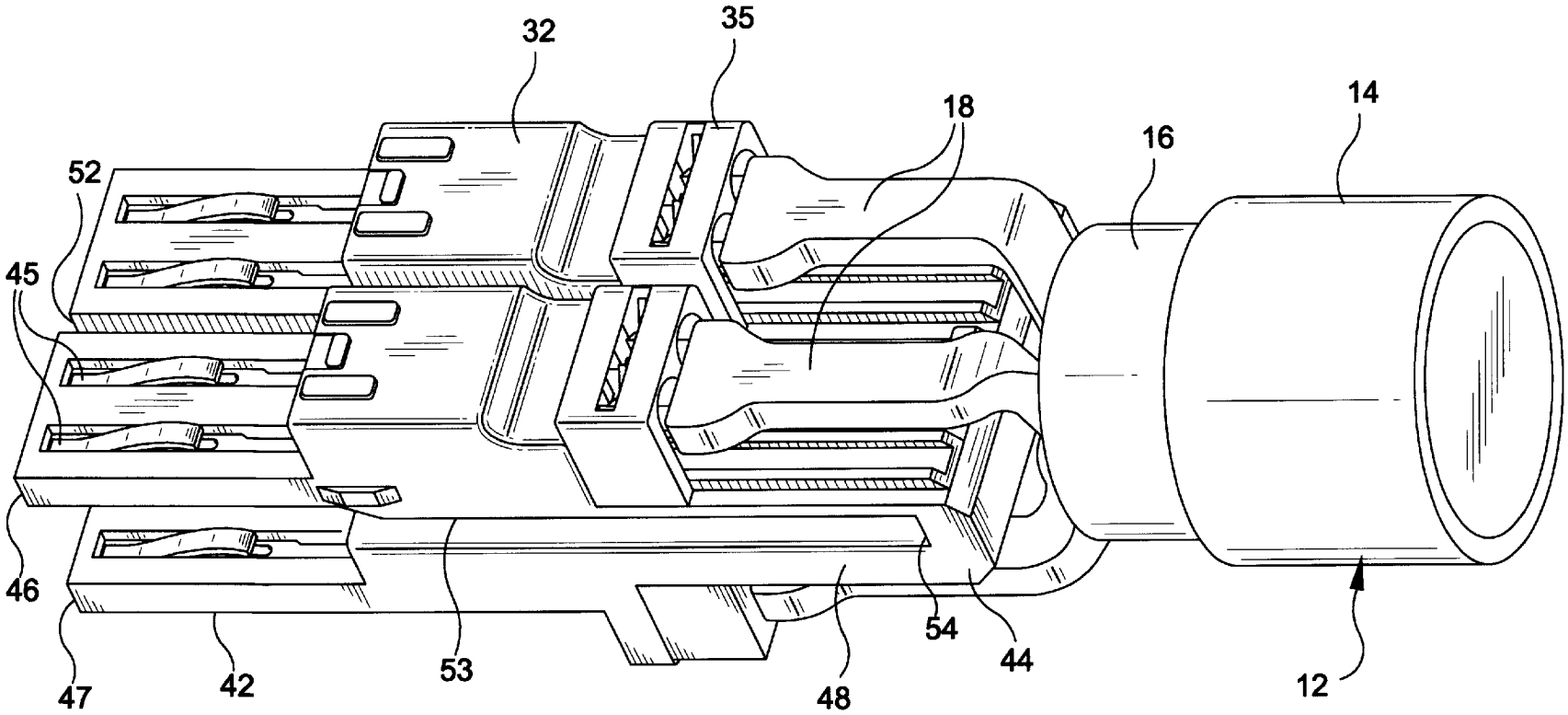
FIG. 5 is a perspective view of the contact support member with the contacts electrically connected to a multi-conductor cable.

Referring now to FIGS. 4 and 5, contact support member 32 supports the plurality of electrical contacts 34 thereon. Each of contacts 34 are elongate electrically conductive metallic members formed of beryllium-copper having a connection end 36 and a termination end 38. Connection end 36 includes a cantilevered element 40 for making mating resilient electrical engagement with similar contacts in the mating jack or plug connector. Termination end 38 includes blade type insulation displacing contact (IDC) portions which are constructed for insulation displacing termination with conductors 18 of cable 12. In the present illustrative embodiment, contacts 34 are positioned in upper and lower longitudinally aligned transversely spaced rows. Termination ends 38 of the lower row extend in the opposite direction than the termination ends of the upper row.

Contact support member 32 is formed of a suitable insulative plastic, such as polyester, and includes a forward interconnection end 42 and a rear termination end 44. Contact support member 32 includes contact grooves 45 in upper and lower platforms 46 and 47 which support contacts 34 in individual electrical isolation. Contact support member 32 includes a conductor support portion 48 which extends rearwardly beyond the IDC termination ends 38 of contacts 34 to the to rear termination end 44 to support the conductors of the cable thereon. Conductor support portion 48 includes raised longitudinal projections 49 which define therebetween conductor receiving spaces 50 and dressing block receiving spaces 51.

Support member 32 also includes a vertical slot 52 disposed between lateral pairs of contacts 34 and a horizontal slot 53 disposed between the upper and lower rows of contacts. Slots 52 and 53 extend longitudinally from the forward interconnection end 42 of support member 32 through the conductor support portion 48 and terminate at a point 54 just intermediate rear end 44 of support member 32. As illustrated, contact support member 32 is designed to accommodate four pairs of contacts, however, it may be appreciated that the contact support member may be designed to accommodate additional pairs of contacts by increasing the width of the support member and providing additional vertical slots between each lateral pair of contacts.

Referring specifically to FIG. 5, the conductors 18 of cable 12 are electrically connected to the contacts 34 on support member 32 prior to assembly of the connector 10. Extending pairs of conductors 18 of cable 12 are separated and positioned for insulation displacing connection with termination ends 38 of contacts 34. Ends of the conductors 18 are placed within receiving openings in the dressing blocks 35 and are electrically connected to contacts 34 in a conventional insulation displacing method. The insulative dressing blocks 35 secure the conductors in place and are provided with one or more raised bosses 55 extending below a bottom portion thereof to be snap-fit into the dressing block receiving spaces 51 of the conductor support portion 48 of support member 32.

As contacts 34 are maintained in close proximity in contact support member 32, it becomes necessary to shield individual contact pairs from adjacent contact pairs to minimize the effects of cross-talk. Returning to FIGS. 1–3, an internal contact shield 58 is provided which encloses the pre-assembled contact support member 32. Shield housing 58 is a die cast conductive, e.g., metallic, member which is slidably insertable into and around contact support member 32 from the forward interconnection end 42 thereof. Contact shield housing 58 serves to shield the contacts 34 as a group and also to shield pairs of contacts 34 from one another both laterally and vertically. Contact shield 58 is an elongate housing roughly the same length as contact support member 32 and has an interconnection end 60 and a termination end 62. Contact shield 58 includes upper and lower U-shaped shield platforms 63*a* and 63*b*, each having a central wall 64 at the interconnection end 60 thereof. The upper and lower shield platforms 63*a* and 63*b* provide effective vertical and horizontal shielding as between the connection ends 36 of contacts 34. When connecting with a mating connector, the interconnection ends are rotated 180 degrees with respect to each other. Thus, the U-shaped platforms of mating connectors will totally enclose, and thereby shield, the connection ends 36 of the contacts 34.

Figure 6A:
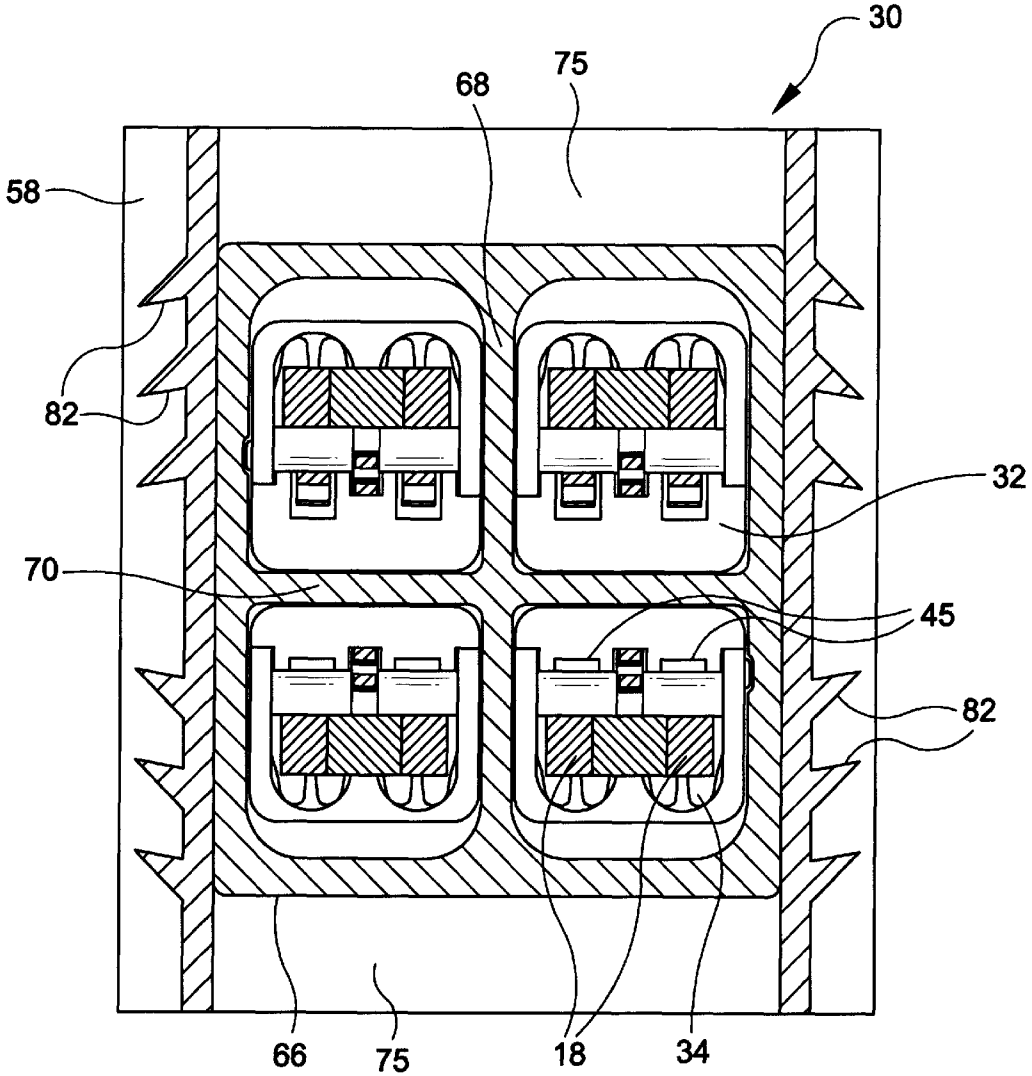
FIGS. 6*a* and 6*b* are cross-sectional views of the termination subassembly of FIG. 3 taken along line 6—6 with the rear end of contact support member and the strain relief device removed and showing alternate embodiments of the contact shield.
Figure 6B:
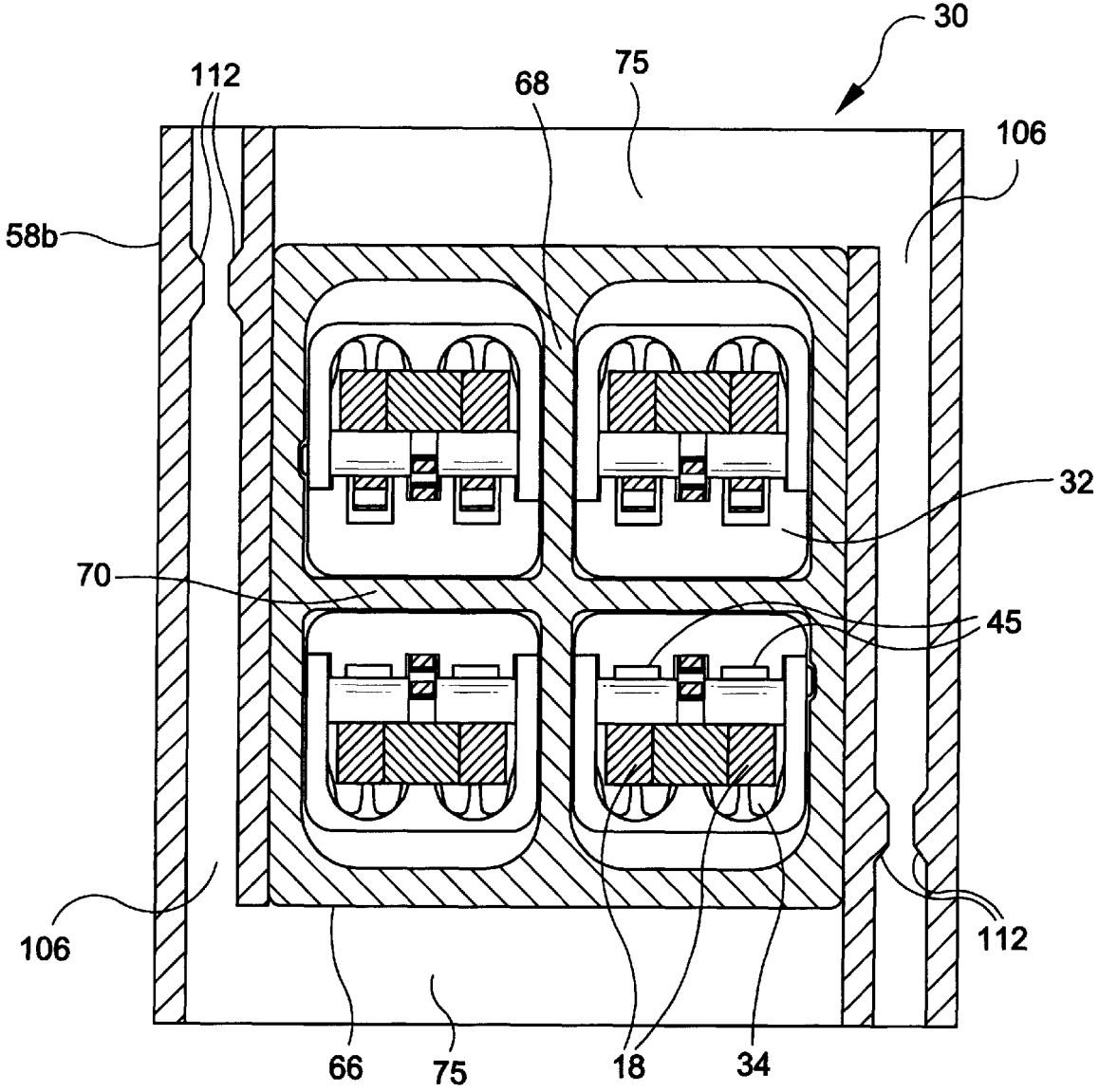

Contact shield 58 includes an enclosed chamber 65 defined by an outer wall 66 at the termination end 62 of the shield. The outer wall 66 provides overall shielding to the termination ends 38 of contacts 34. Referring additionally to FIGS. 6*a* and 6*b*, contact shield 58 further includes a vertical and a horizontal internal wall 68 and 70 forming a contiguous cross member extending along the length of the chamber 65 and terminating intermediate termination end 62 of shield 58. Vertical internal wall 68 separates and shields lateral pairs of contacts 34 and horizontal wall 70 separates and shields the upper and lower rows of contacts 34. Unlike prior art connectors, the outer and inner walls of the contact shield 58 extend further rearward past the termination ends 38 of contacts 34 to the conductor supporting portion 48 of the contact support member 32 thereby also providing effective overall and individual shielding of the exposed pairs of conductors 18 positioned within the connector housing. Again, it may be appreciated that contact shield 58 may be designed to shield additional pairs of contacts 34 and conductors 18 by increasing its width and providing additional horizontal and/or vertical walls.

Termination sub-assembly 30 is provided with a strain relief device 72 for securing the cable 12 to the connector 10. Strain relief device 72 is comprised of a pair of matching strain relief components which are formed from an electrically conductive metallic material. The preferred embodiment of the strain relief component 74 is shown in FIGS. 1–3 and 7. Alternate embodiments of the strain relief components are discussed further in detail below. Generally, a pair of strain relief components are inserted in oppositely disposed receiving slots 75 located at the termination end 62 of the contact shield housing 58. Preferably, the receiving slots 75 are sized so that the strain relief components are in close electrical contact with the slots when inserted therein. The strain relief components when inserted in receiving slots 75 define a circular opening which is generally concentric with the chamber 65 of contact shield 58. When the strain relief components are inserted in receiving slots 75 and brought together, the circular opening defined therebetween will be reduced in size in order to frictionally secure and electrically engage the outer cable braid 16 of the cable 12 therebetween and secure the cable thereat.

Strain relief device 72 also provides continuity of ground between the cable 12 and the contact shield housing 58. Prior to installation of the cable 12, a portion of the cable jacket 14 is removed to reveal the cable ground braid 16. It is this portion of the cable 12 that the strain relief components frictionally engage. Thus, the strain relief components are in electrical contact with the cable braid 16. Since the strain relief components are made of an electrically conductive metallic material, and since they are in electrical communication with the receiving slots 75 of the electrically conductive contact shield housing 58, the ground of the cable 12 may be carried from the cable braid 16 through the strain relief component to the contact shield housing 58. To enhance electrical contact between the strain relief components and the receiving slot 75, the strain relief component may be provided with one or more raised contact protrusions. When the strain relief components are inserted into receiving slots 75 of the contact shield 58, the raised contact protrusion "skives" or cuts into a wall of the slot 75 and is mechanically forced thereagainst thereby providing secure electrical contact between the strain relief component and the contact shield 58. Alternatively, the raised contact protrusion provides for an interference fit making good electrical continuity between the shield housing 58 and the strain relief component.

Figure 7:
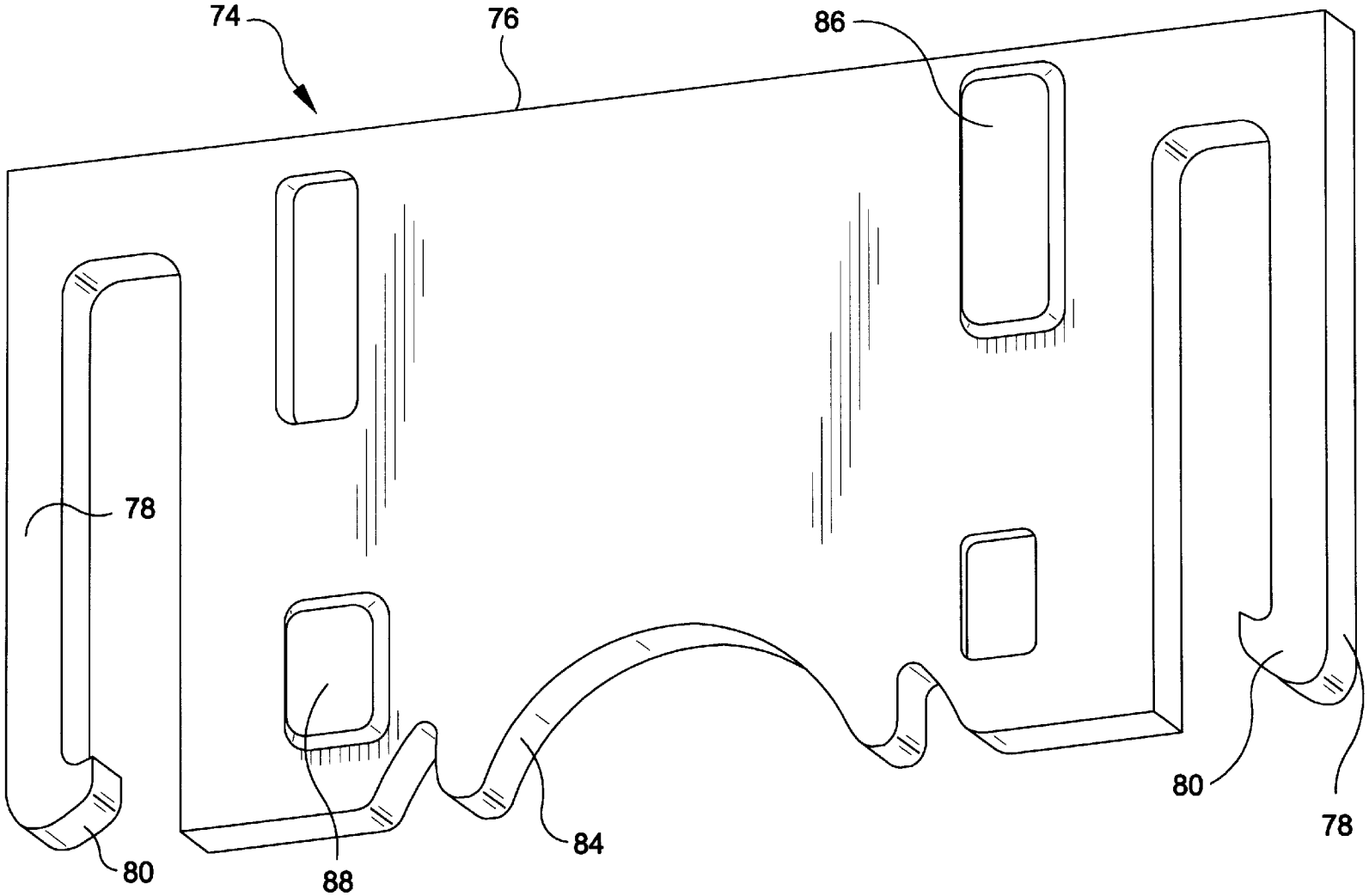
FIG. 7 is a perspective view of the preferred embodiment of a strain relief member.

FIG. 7 illustrates the preferred embodiment of the strain relief component 74. Strain relief component 74 generally includes a top wall 76 and a pair of J-shaped side arms 78 extending downwardly from the top wall. The "hooks" 80 of the J-shaped arms 78 are directed inwardly and engage cooperating outwardly directed ratchet teeth 82 formed on the outer wall 66 of the shield housing 58 at the termination end 62 thereof, as shown in FIGS. 1, 2 and 6*a*. Side arms 78 are deflectable which, along with the positioning of ratchet teeth 82, allow for one-way downward movement of the strain relief components 74 within receiving slots 75 of shield 58. The internal surface of top wall 76 of strain relief component 74 is generally curved and is provided with a rib 84 to assist in frictional securement of the cable braid 16. Strain relief component 74 also includes an arrangement of upper and lower raised contact protrusions 86 and 88 which provide two-position enhanced electrical contact between strain relief component 74 and contact shield 58. Upper protrusions 86 are oppositely disposed on the major surfaces of strain relief component 74 and are laterally offset from similarly disposed lower protrusions 88.

Strain relief components 74 operate in the following manner. Strain relief components 74 are inserted into the opposing slots 75 of the contact shield 58 with the side arms 78 positioned along the sides of contact shield 58. Strain relief components 74 are then manually pushed toward each other to provide for ratchet engagement of the J-hooks 80 and respective teeth 82 of contact shield 58. When the strain relief components 74 are inserted within receiving slots 75 and make electrical contact with the cable braid 16 in a pre-load stage, the lower protrusions 88 are in forced electrical contact with the receiving slot 75. As the strain relief components 74 are pressed downwardly to frictionally secure the cable braid 16 under load, the upper protrusions 86 are mechanically forced against the receiving slot 75. Thus, electrical ground continuity is maintained in both a pre-load and a loaded position. Strain relief components 74 are pushed toward each other until the outer cable braid 16 of cable 12 is secured within the circular opening which is continually decreasing in size by the movement of the components 74 with respect to each other. As the strain relief components 74 press together, the side arms 78 move downwardly along the ratchet teeth 82 thereby preventing the strain relief components 74 from backing away from each other. Thus, strain relief components 74 independently engage and lock to the shield housing ratchet teeth 82. Because the locking zone is totally separate from the strain relieving zone and grounding zone, the strain relief of the present invention provides more stability since the locking zone is not subjected to strains that could be caused during cable pull out.

Figure 8:
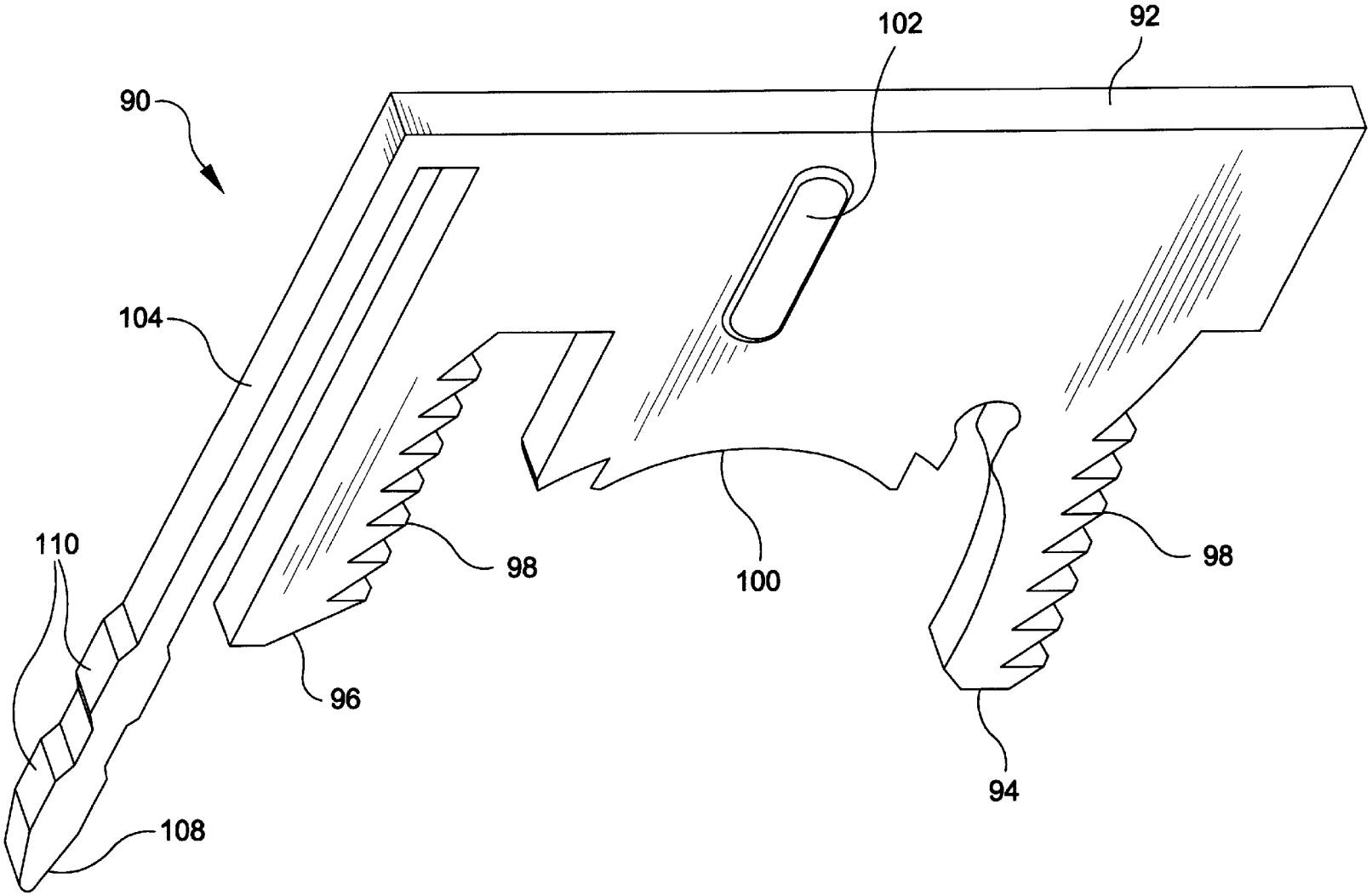
FIG. 8 is a perspective view of an alternate embodiment of a strain relief member.

FIG. 8 illustrates an alternate embodiment of a strain relief component 90. Strain relief component 90 is generally U-shaped having a top wall 92 and downwardly extending side walls or legs 94 and 96. Legs 94 and 96 are deflectable and include ratchet teeth 98. Ratchet teeth on leg 94 are directed outwardly while ratchet teeth on leg 96 are directed inwardly. The strain relief components 90 are oriented within the receiving slots 75 of the contact shield **58*b* so that legs 94 of each component engage legs 96 of the other. The positioning of ratchet teeth 98 permit the moveable one-way ratchet engagement of the components 90 with respect to the other. The delectability of legs 94 and 96 permits such ratchet movement of components 90. The internal surface of legs 94 as well as the internal surface of top wall 92 are generally curved so as to form a circular opening which is generally concentric with the chamber 65 of contact shield 58*b*. In order to assist in frictional securement of the cable braid 16, a rib 100 is provided on the internal surface of the top wall 92. These ribs provide increased localized friction against the cable braid 16**.

Strain relief component 90 also includes one or more raised contact protrusions 102, for providing enhanced electrical contact between the shield 58 and the strain relief component 90 as described above, and a locking arm 104 which extends downwardly from top wall 92. As shown in FIG. **6*b*, locking arm 104 fits into a cooperating locking hole 106 of an alternate embodiment of the contact shield 58*b* when strain relief component 90 is inserted in receiving slot 75. Locking holes 106 also initially serve to properly orientate strain relief components 90 within the opposing receiving slots 75 of the shield 58*b*. Locking arm 104 includes a tapered end 108 and one or more locking protrusions 110. Locking protrusions 110 engage cooperating ribs 112 formed in locking hole 106 as shown in FIG. 6*b***.

Strain relief components 90 operate in the following manner. Strain relief components 90 are inserted into the opposing slots 75 of the contact shield **58*b* with the locking arms 104 being inserted into the adjacent locking hole 106. Strain relief components 90 are then manually pushed toward each other to provide for ratchet engagement of the respective teeth of legs 94 and 96. Strain relief components 90 are pushed toward each other until the outer cable braid 16 of cable 12 is secured within the circular opening which is continually decreasing in size by the movement of the components 90 with respect to each other. As the strain relief components 90 press together, the locking arm 104 moves downwardly in locking hole 106 until the locking protrusions 110 engage and pass the locking ribs 112 of the hole 106. The tapered end 108 of locking arm 104 allows for inward movement of the locking arm, but the arrangement of locking protrusions 110 and cooperating ribs 1 12 prevent outward movement. Thus, in addition to the ratchet teeth 98 of the strain relief component 90, the locking arm with locking protrusions 110 prevent strain relief components 90** from backing away from each other.

Once the strain relief device 72 is engaged, housing halves **20*a* and 20*b* may be snap-fitted together to complete the assembly. Housing halves 20*a* and 20*b* shown in FIGS. 1–3 are formed in a plug configuration, but may alternatively be formed in a jack configuration. The plug and jack are mating connectors which may be mechanically and electrically connected by rotating the interconnection end of the plug 180 degrees and inserting it into the interconnection end of the jack. A deflectable latch 114** may be provided on either the plug or jack to provide for secure repeated connections and disconnections between the connectors.

The present invention thus provides an electrical connector having an improved connector shield and dual use strain relief component. Unlike prior connectors, the present invention features a contact shield which extends further back into the cable dressing area. By extending the shield further back, the cross-talk performance of the connector is dramatically improved. Also, the metallic strain relief components provide an improved ground path from the cable braid to the contact shield while eliminating the need for extra grounding components, such as spring clips, within the connector. Furthermore, the high strength of the metallic strain relief component allows for the use of a thinner strain relief device than conventional connectors.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An electrical connector for terminating discrete conductors of a multi-conductor cable comprising:

at least one electrically insulative contact support member having a connection end and a cable termination end;

a plurality of electrical contacts having conductor connection end portions for electrical connection with said conductors, said contacts being supported on said at least one contact support member; and an electrically conductive shield member supporting said at least one contact support member, said shield member including a contiguous cross member portion having a horizontal extent and a vertical extent for shielding both horizontally and vertically between the conductor connection end portions of at least two contacts separated by said cross member portion, said cross member portion extending rearwardly beyond said electrical contact conductor connection end portions to provide shielding between a portion of at least two of the discrete conductors of the multi-conductor cable separated by said cross member portion.

2. The electrical connector as defined in claim 1, further comprising an electrically insulative connector housing for supporting said contact shield housing and said contact support member therein.

3. The electrical connector as defined in claim 1, comprising a single contact support member, wherein said contact support member includes a horizontal and a longitudinal slot for receiving said cross member portion of said shield member.

4. The electrical connector as defined in claim 1, wherein said contact end portions comprise insulation displacement contacts and said connector further comprises a plurality of dressing blocks, said dressing blocks being snap-fit over the insulation displacement contacts to help secure said conductors thereto.

5. The electrical connector as defined in claim 2, wherein said insulative connector housing comprises two connector halves which are snap-fit together to substantially enclose said contacts and said contact shield.

6. The electrical connector as defined in claim 1, further comprising a cable strain relief device positioned adjacent said termination end of said contact support member for securing the cable thereat.

7. The electrical connector as defined in claim 6, wherein said cable strain relief device comprises first and second strain relief members, each strain relief member having a pair of legs positioned along opposed edges thereof, each of said legs including an engagement member thereon, said first and second strain relief members defining a bounded opening therebetween and being moveable with respect to each other to reduce the size of said bounded opening for securingly engaging the cable thereat and wherein said contact shield housing includes engagement elements arranged along at least two opposed side walls thereof for mating cooperation with the engagement members of said strain relief members to thereby lockingly engage said first and second strain relief members to said cable.

8. The electrical connector as defined in claim 7, wherein said engagement member on said first and second strain relief members and said engagement elements on said contact shield include interengageable teeth for permitting ratchet-type movement therebetween.

9. The electrical connector as defined in claim 7, wherein said shield member includes an upper and a lower wall each having a slot disposed therethrough for receiving each of said strain relief members.

10. The electrical connector as defined in claim 7, wherein said first and second strain relief members are made from an electrically conductive material and wherein at least one of said first and second strain relief members is in electrical contact with said shield member for providing ground continuity between the cable and said shield member.

11. The electrical connector as defined in claim 9, wherein said first and second strain relief members are made from an electrically conductive material and wherein at least one of said first and second strain relief members includes at least one raised protrusion which is mechanically forced against an inner wall of said slot of said contact shield when said strain relief member is inserted in said slot thereby ensuring electrical contact between said strain relief member and said contact shield.

12. The electrical connector as defined in claim 6, wherein said cable strain relief device comprises first and second interengageable strain relief members each having a pair of spaced legs, one leg having outwardly directed engagement elements and the opposing leg having inwardly directed engagement elements, the outwardly directed engagement elements on a leg of one strain relief member engaging the inwardly directed engagement elements on a leg of the other strain relief member, said first and second strain relief members defining a bounded opening adjacent said termination end of said contact support member and being movable with respect to each other to reduce the size of said opening and for frictionally securing said cable thereat.

13. The electrical connector as defined in claim 12, wherein said engagement elements on said first and second strain relief members include interengageable teeth for permitting ratchet-type movement therebetween.

14. The electrical connector as defined in claim 12, wherein said shield member includes an upper and a lower wall each having a slot disposed therethrough for receiving each of said strain relief members.

15. The electrical connector as defined in claim 12, wherein said first and second strain relief members are made from an electrically conductive material and wherein at least one of said first and second stain relief members is in electrical contact with said contact shield for providing ground continuity between the cable and said contact shield.

16. The electrical connector as defined in claim 14, wherein said first and second strain relief members are made from an electrically conductive material and wherein at least one of said first and second strain relief members includes at least one raised protrusion which is mechanically forced against an inner wall of said slot of said contact shield when said strain relief member is inserted in said slot thereby ensuring electrical contact between said strain relief member and said contact shield.

17. An electrical connector for terminating discrete conductors of a multi-conductor cable comprising:

a connector housing having a conductor termination end and a connection end, said termination end of said housing defining a first bounded opening for passage of said cable therethrough; and a cable strain relief device positioned adjacent said bounded opening of said housing, said cable strain relief device including first and second strain relief members, each strain relief member having a pair of legs positioned along opposed edges thereof, each of said legs including at least one engagement member thereon, said first and second strain relief members defining a second bounded opening therebetween and being moveable with respect to each other to reduce the size of said second bounded opening for securingly engaging the cable thereat, wherein said housing includes engagement elements along at least two opposed side walls for cooperation with the engagement members of said strain relief members to thereby lockingly engage said first and second strain relief members to said contact shield housing.

18. The electrical connector as defined in claim 17, wherein said engagement member on said first and second strain relief members and said engagement elements on said housing include interengageable teeth for permitting ratchet-type movement therebetween.

19. The electrical connector as defined in claim 17, wherein said connector housing includes opposing slots for receiving each of said strain relief members.

20. The electrical connector as defined in claim 17, wherein said connector housing and said first and second strain relief members are made from an electrically conductive material, and wherein at least one of said first and second stain relief members is in electrical contact with said connector housing for providing ground continuity between the cable and said contact shield.

21. The electrical connector as defined in claim 19, wherein said connector housing and said first and second strain relief members are made from an electrically conductive material and wherein at least one of said first and second strain relief members includes at least one raised protrusion which is mechanically forced against an inner wall of said slot of said connector housing when said strain relief member is inserted in said slot thereby ensuring electrical contact between said strain relief member and said housing.

22. An electrical connector for terminating discrete conductors of a multi-conductor cable which includes a ground, the connector comprising:

an electrically conductive shield housing having a connection end and a cable termination end;

an insulative contact support member supported within the shield housing;

a plurality of contacts provided on the contact support member wherein each contact includes a conductor termination end and a connector end; and a cable strain relief device positioned adjacent said termination end of said shield housing for securing the cable thereat, said cable strain relief device comprising an electrically conductive material and being in electrical communication with said shield housing and the cable ground for providing electrical continuity therebetween.

23. An electrical connector for terminating discrete conductors of a multi-conductor cable comprising:

at least one electrically insulative contact support member having a connection end and a cable termination end;

a plurality of electrical contacts each having a connection end and a conductor termination end portion for electrical connection with the conductors, said contacts being supported on said at least one contact support member, said contact support member including a conductor support portion extending from the termination end portions of the contacts to the cable termination end of the contact support member; and an electrically conductive shield member including a contiguous cross member having a horizontal extent and a vertical extent for shielding both horizontally and vertically between the conductor connection end portions of at least two contacts separated by an extent of said cross member, said cross member extending rearwardly beyond said conductor connection end portions to provide shielding between at least two of the discrete conductors of the multi-conductor cable.

24. A method for terminating discrete conductors of a multi-conductor cable comprising the steps of:

providing at least one electrically insulative contact support member;

supporting plural electrical contacts on said at least one contact support member, said contacts having conductor connection end portions;

connecting discrete conductors of said multi-conductor cable to said conductor connection end portions; and inserting said at least one contact support member along a longitudinal axis into an electrically conductive shield member, said shield member including a contiguous cross member having a horizontal extent and a vertical extent for shielding both horizontally and vertically between the conductor connection end portions of at least two contacts separated by an extent of said cross member, said cross member extending rearwardly beyond said conductor connection end portions to provide shielding between at least two of the discrete conductors of the multi-conductor cable.

25. The method as defined in claim 24, wherein said contact support member includes a horizontal and a vertical slot for receiving said cross member of said shield member.

26. The method as defined in claim 24, further comprising the step of substantially encapsulating said shield member with an outer protective housing.

27. The method as defined in claim 26, wherein said outer protective housing comprises two halves which are snap-fit together to substantially enclose said shield member.

28. The method as defined in claim 24, further comprising the step of engaging a cable strain relief device of said shield member for securing said cable thereto.

* * * * *